US006763855B2

(12) United States Patent
Rougvie

(10) Patent No.: US 6,763,855 B2
(45) Date of Patent: Jul. 20, 2004

(54) THROUGH-AIR-DRYING BASE FABRIC

(75) Inventor: David S. Rougvie, Appleton, WI (US)

(73) Assignee: Albany International Corp., Albany, NY (US)

( * ) Notice: Subject to any disclaimer, the term of this patent is extended or adjusted under 35 U.S.C. 154(b) by 91 days.

(21) Appl. No.: 10/021,363

(22) Filed: Oct. 30, 2001

(65) Prior Publication Data

US 2003/0079850 A1 May 1, 2003

(51) Int. Cl.[7] ..... D03D 15/00
(52) U.S. Cl. ..... 139/383 A; 139/426 R; 442/217
(58) Field of Search ..... 139/383 A, 383 AA, 139/426 R; 442/217

(56) References Cited

U.S. PATENT DOCUMENTS 2,554,034 A * 5/1951 Koester et al. ..... 139/426 R
4,231,401 A * 11/1980 Matuska ..... 139/383 A
4,676,278 A 6/1987 Dutt
5,188,884 A * 2/1993 Smith ..... 428/193
5,624,790 A 4/1997 Trokhan et al.
6,017,417 A 1/2000 Wendt et al.
6,397,899 B1 * 6/2002 Kobayashi et al. ..... 139/383 A

* cited by examiner

*Primary Examiner*—John J. Calvert
*Assistant Examiner*—Robert H. Muromoto, Jr.
(74) *Attorney, Agent, or Firm*—Frommer Lawrence & Haug LLP; Ronald R. Santucci

(57) ABSTRACT

A papermaker's fabric, designed for use as a base fabric for a TAD belt, but also usable on the forming, press and dryer sections of a paper machine, has a plurality of warp yarns interwoven with a plurality of weft yarns. The warp yarns are of two types. Those of the first type weave with the weft yarns in a plain weave, while those of the second type weave with the weft yarns in a 2×2 twill weave. The warp yarns of the first type alternate with those of the second type, which undulate between adjacent yarns of the first type to give the fabric a desired openness.

16 Claims, 3 Drawing Sheets

THROUGH-AIR-DRYING BASE FABRIC

BACKGROUND OF THE INVENTION

1. Field of the Invention

The present invention relates to the papermaking arts, and specifically to the manufacture of bulk tissue and toweling, which may collectively be referred to as bulk tissue. The present invention also relates to the manufacture of nonwoven articles and fabrics by processes such as hydroentanglement. In particular, the present invention relates to belts, which have had a functional polymeric resin material deposited in precise preselected areas onto their base structures to fill those areas and, when desired, to form a layer of desired thickness thereover. Belts of this type are used in the manufacture of bulk tissue and towel, and of nonwoven articles and fabrics.

2. Description of the Prior Art

Soft, absorbent disposable paper products, such as facial tissue, bath tissue and paper toweling, are a pervasive feature of contemporary life in modern industrialized societies. While there are numerous methods for manufacturing such products, in general terms, their manufacture begins with the formation of an embryonic paper web in the forming section of a paper machine. The embryonic paper web is then transferred to a through-air-drying (TAD) fabric or belt by means of an air flow, brought about by vacuum or suction, which deflects the web and forces it to conform, at least in part, to the topography of the TAD fabric or belt. Downstream from the transfer point, the web, carried on the TAD fabric or belt, passes through a through-air dryer, where a flow of heated air, directed against the web and through the TAD fabric or belt, dries the web to a desired degree. Finally, downstream from the through-air dryer, the web may be adhered to the surface of a Yankee dryer and imprinted thereon by the surface of the TAD fabric or belt, for further and complete drying. The fully dried web is then removed from the surface of the Yankee dryer with a doctor blade, which foreshortens or crepes the web and increases its bulk. The foreshortened web is then wound onto rolls for subsequent processing, including packaging into a form suitable for shipment to and purchase by consumers.

As noted above, there are many methods for manufacturing bulk tissue products, and the foregoing description should be understood to be an outline of the general steps shared by some of the methods. For example, the use of a Yankee dryer is not always required, as, in a given situation, foreshortening may not be desired, or other means, such as "wet creping", may have already been taken to foreshorten the web.

The present application is concerned, at least in part, with the TAD fabrics or belts used on the through-air dryer of a bulk tissue machine. More specifically, the present application is concerned with a TAD belt of the variety developed by Procter & Gamble in the 1980's and first disclosed in U.S. Pat. Nos. 4,528,239; 4,529,480; and 4,637,859 to Trokhan. The TAD belt in question comprises a foraminous woven element, that is, a woven base fabric, having a coating of a polymeric resin material in preselected areas. The polymeric resin material provides the TAD belt with a macroscopically monoplanar, patterned, continuous network surface which serves to define within the TAD belt a plurality of discrete, isolated deflection conduits or holes. To produce the TAD belt, the foraminous woven element is thoroughly coated with a liquid photosensitive resin to a controlled thickness above its upper surface, and a mask or a negative having opaque and transparent regions which define a desired pattern is brought into contact with the surface of the liquid photosensitive resin and the resin is exposed to actinic radiation through the mask. The radiation, typically in the ultraviolet (UV) portion of the spectrum, cures those portions of the resin exposed through the mask, but does not cure those portions shadowed by the mask. The uncured resin is subsequently removed by washing to leave behind the foraminous woven element with a coating in the desired pattern formed by the cured resin.

The polymeric resin material may alternatively form a plurality of discrete protuberances on its surface by using an appropriately designed mask. That is to say, the plurality of discrete protuberances is the reverse of a continuous network having holes. Instead, the pattern is of discrete areas which are occluded or blocked by the polymeric resin material in an otherwise open foraminous woven element. Belts of this kind may be used in the forming section of a bulk tissue machine to form embryonic paper webs having discrete regions of relatively low basis weight in a continuous background of relatively high basis weight. Belts of this kind may also be used to manufacture nonwoven articles and fabrics, which have discrete regions in which the density of fibers is less than that in adjacent regions, by processes such as hydroentanglement.

Moreover the polymeric resin material may also form a semicontinuous network on the foraminous woven element. That is to say, the polymeric resin material may form, with the use of an appropriately designed mask, a framework of protuberances arranged in a semicontinuous pattern to provide a semicontinuous pattern of deflection conduits. By "semicontinuous" is meant that each protuberance extends substantially throughout the belt in an essentially linear fashion, and that each protuberance is spaced apart from adjacent protuberances. As such, the protuberances may be lines which are generally straight, parallel and equally spaced from one another, or may be in the shape of zigzags which are generally parallel and equally spaced from one another.

The present invention is a foraminous woven element, that is, a woven base fabric, for TAD belts of the foregoing types.

SUMMARY OF THE INVENTION

The present invention, then, is a base fabric for a through-air-drying (TAD) belt, although it may also be used on the forming, press and dryer sections of a paper machine. As such, it is a papermaker's fabric which comprises a plurality of warp yarns interwoven with a plurality of weft yarns.

The warp yarns are of two types. Those of the first type weave with the weft yarns in a plain weave, and those of the second type weave with the weft yarns in a 2×2 twill weave. In a plain weave, a warp yarn passes alternatively over and under successive weft yarns, while, in a 2×2 twill weave, a warp yarn passes alternately over and under two successive weft yarns. The warp yarns of the first type alternate with those of the second type, which undulate between adjacent warp yarns of the first type to give the fabric a desired openness.

The present invention will now be described in more complete detail, with frequent reference being made to the figures identified below.

DETAILED DESCRIPTION OF THE PREFERRED EMBODIMENT

Figure 1:
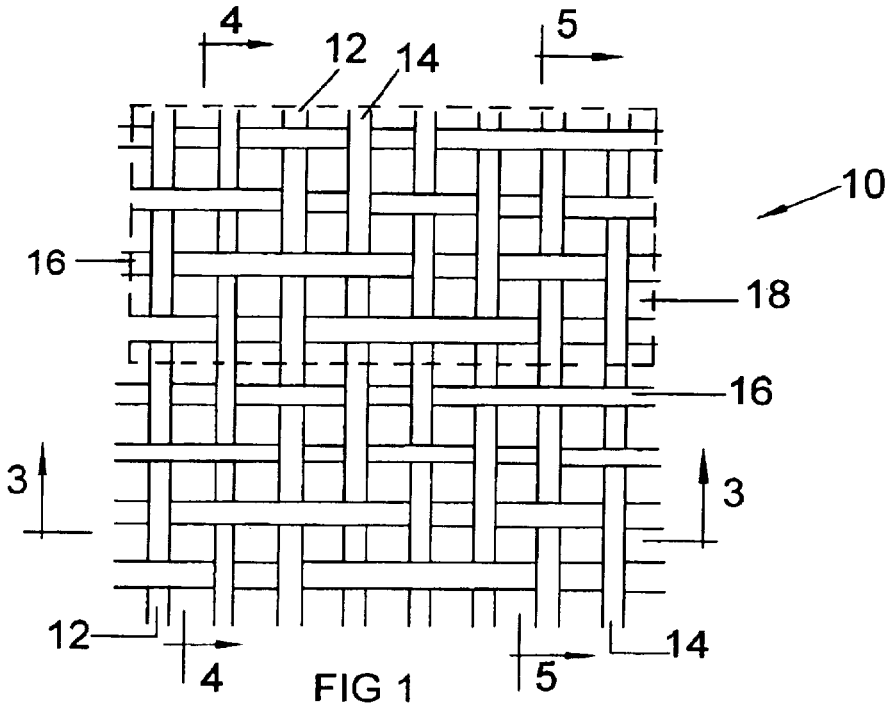
FIG. 1 is a schematic plan view of one side of the base fabric.

Turning now to the figures identified above, FIG. 1 is a plan view of one side of base fabric 10, which could be either its forming side or wear side. The former is so-called because it is the side which faces the newly formed paper web when the base fabric 10 is part of a TAD belt running on a paper machine. The latter is so called because it passes over stationary components on the paper machine and is therefore subject to wear by abrasion. The base fabric 10 is woven from warp yarns 12, warp yarns 14, and weft yarns 16.

Warp yarns 12 and warp yarns 14, which are in the machine direction as the base fabric 10 is flat-woven and joined into endless form with a woven seam, alternate with one another. That is to say, a warp yarn 12 is between each pair of adjacent warp yarns 14, and a warp yarn 14 is between each pair of adjacent warp yarns 12.

Warp yarns 12 weave with weft yarns 16, which are oriented in the cross-machine direction when base fabric 10 has been joined into endless form, in the manner of a plain weave, wherein each warp yarn 12 passes over and under successive weft yarns 16.

Warp yarns 14, alternating with warp yarns 12 across the base fabric 10, weave with weft yarns 16 in a full twill weave, wherein each warp yarn 14 passes over and under two successive weft yarns 16.

One complete repeat of the weave pattern for base fabric 10 is contained within the dashed rectangle in FIG. 1. It will be observed that each weft yarn 16 makes a long float over three consecutive warp yarns 14,12,14 on the side of the fabric 10 shown in FIG. 1. Traditionally, such a float would appear on the wear side, but this need not be the case in the present invention.

Figure 2:
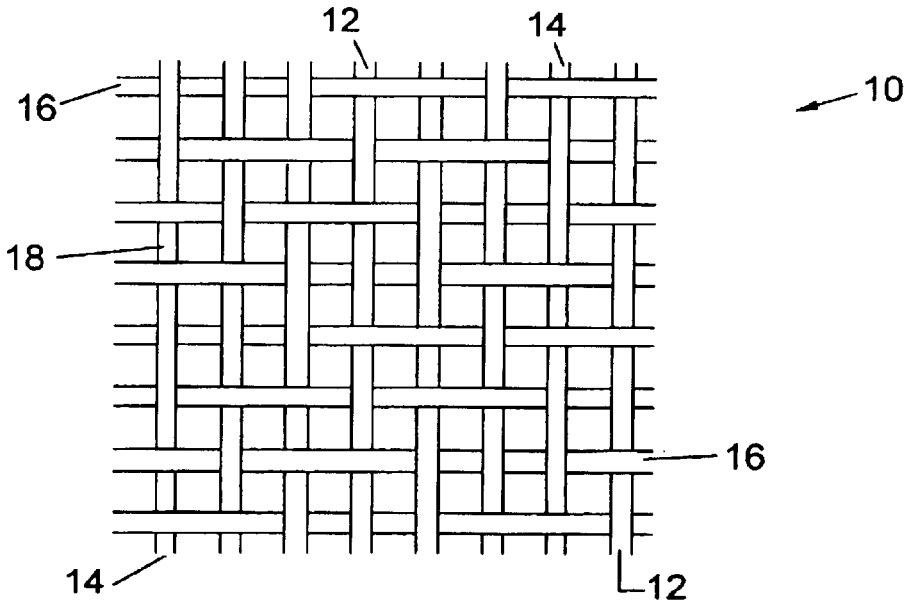
FIG. 2 is a schematic plan view of the other side of the base fabric.

FIG. 2 is a plan view of the other side of the base fabric 10. The view shown in FIG. 2 is simply that obtained by turning over that shown in FIG. 1, so that, for example, warp yarn 18, shown at the extreme right in FIG. 1, appears at the extreme left in FIG. 2.

Figure 3:
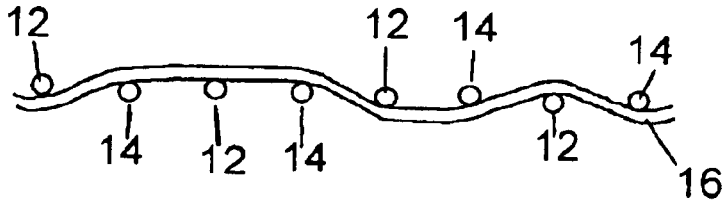
FIG. 3 is a cross-sectional view taken as indicated by line 3—3 in FIG. 1.

FIG. 3 is a cross-sectional view taken as indicated by line 3—3 in FIG. 1. It shows the contour taken by weft yarn 16 in one repeat of the weave pattern, and it is of interest to note that weft yarn 16 passes under two consecutive warp yarns 12,14 each time it passes to the lower side of the base fabric 10 in the figure. The significance of this will be indicated below.

Figure 4:
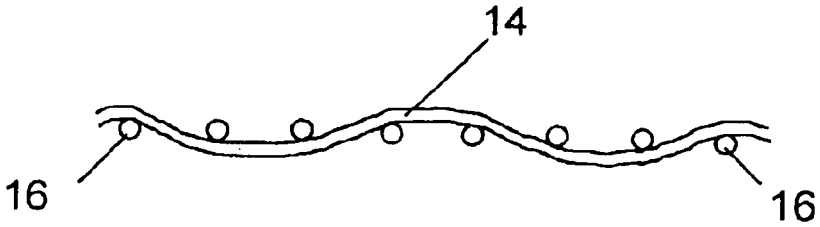
FIG. 4 is a cross-sectional view taken as indicated by line 4—4 in FIG. 1.
Figure 5:
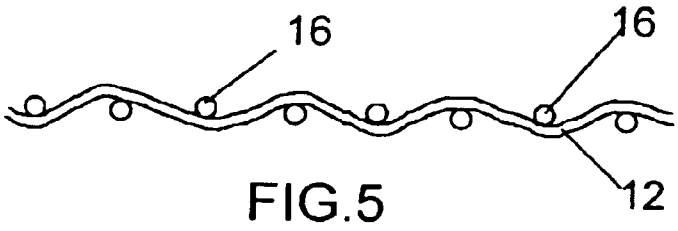
FIG. 5 is a cross-sectional view taken as indicated by line 5—5 in FIG. 1.

FIG. 4 is a cross-sectional view taken as indicated by line 4—4 in FIG. 1. It shows the contour taken by warp yarn 14 in two repeats of the weave pattern for base fabric 10. In like manner, FIG. 5 is a cross-sectional view taken as indicated by line 5—5 in FIG. 1, showing the contour taken by warp yarn 12 in two repeats of the weave pattern for base fabric 10.

Warp yarns 12, warp yarns 14 and weft yarns 16 are preferably monofilament yarns of any of the synthetic polymeric resins used in the production of such yarns for paper machine clothing. Polyester and polyamide are but two examples for such materials. Other examples of such materials are yarns of polyphenylene sulfide (PPS), which is commercially available under the name RYTON®, and yarns of a modified heat-, hydrolysis-, and contaminant-resistant polyester of the variety disclosed in commonly assigned U.S. Pat. No. 5,169,499, and used in dryer fabrics sold by Albany International Corp. under the trademark THERMONETICS®. The teachings of U.S. Pat. No. 5,169,499 are incorporated herein by reference.

Moreover, warp yarns 14 may be colored black by adding an appropriate pigment to the material extruded to produce them, so that they will be opaque to the ultraviolet (UV) radiation used to cure the liquid photosensitive resin applied to the base fabric 10 to produce a TAD belt. As is well known to those of ordinary skill in the art, this approach is taken to provide the back side of the TAD belt with some texture in order to make the vacuum applied to the TAD belt to deflect the web and cause it to conform to the topography thereof less abrupt, thereby to reduce the incidence of pinholing.

The present base fabric 10 has an open structure, which allows the liquid photosensitive resin to encapsulate warp yarns 12,14 and weft yarns 16 more fully, thereby preventing resin loss. In other words, the openness of the structure of base fabric 10 enables the mechanical interlock between the cured resin and the warp yarns 12,14 and the weft yarns 16 to be more complete and effective.

Figure 6:
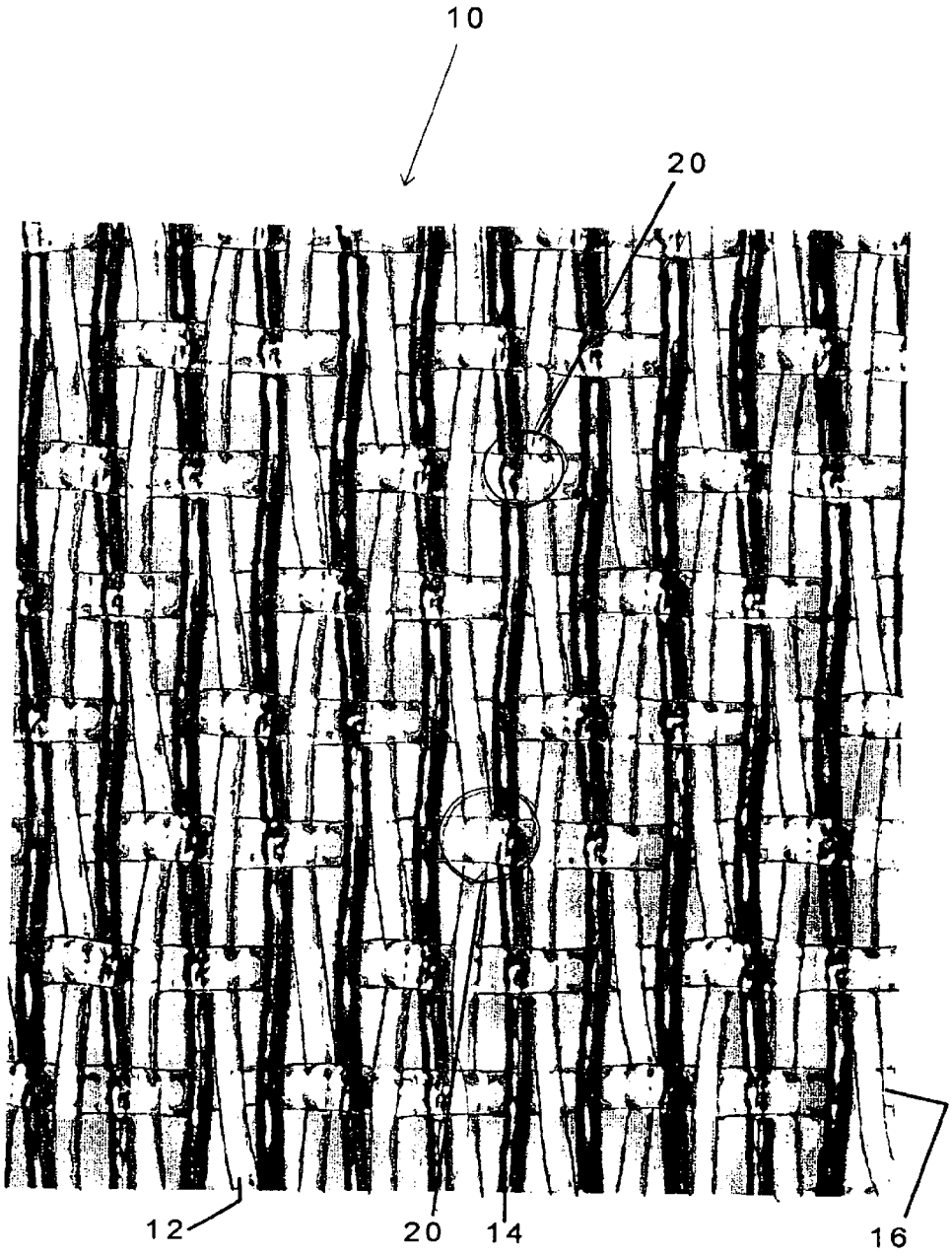
FIG. 6 is a plan view of the side of the fabric shown in FIG. 2 as it actually appears.

This openness is shown most clearly in FIG. 6, a plan view of the side of the fabric shown in FIG. 2 as it actually appears. Warp yarns 14 are traded back and forth between adjacent warp yarns 12 by the weave pattern between points 20 where a weft yarn 16 passes over both warp yarn 12 and warp yarn 14. The resulting undulation of warp yarns 14 between the warp yarns 12 on each of its two sides gives the fabric 10 its characteristic openness.

Modifications to the above would be obvious to those of ordinary skill in the art, but would not bring the invention so modified beyond the scope of the appended claims.

What is claimed is:

1. A papermaker's fabric for use as a base fabric for a TAD belt, or for the forming, press and dryer sections of a paper machine, said fabric comprising:

a plurality of warp yarns interwoven with a plurality of weft yarns, some of said warp yarns being of a first type and some of said warp yarns being of a second type, said warp yarns of said first type interweaving with said plurality of weft yarns in a plain weave, and said warp yarns of said second type interweaving with said plurality of weft yarns such that each said warp yarn of said second type alternately passes over and under successive pairs of adjacent weft yarns on a repeating pattern, wherein warp yarns of said first type alternate with warp yarns of said second type, said warp yarns of said second type undulating between adjacent warp yarns of said first type to give said fabric a desired openness.

2. A papermaker's fabric as claimed in claim 1, wherein each warp yarn of said first type is between two successive warp yarns of said second type.

3. A papermaker's fabric as claimed in claim 1, wherein each warp yarn of said second type is between two successive warp yarns of said first type.

4. A papermaker's fabric as claimed in claim 1, wherein said warp yarns of said second type undulate between points where a weft yarn passes over a warp yarn of said first type and a warp yarn of said second type.

5. A papermaker's fabric as claimed in claim 1, wherein said warp yarns are oriented in the machine direction of said paper machine, and said weft yarns are oriented in the cross-machine direction.

6. A papermaker's fabric as claimed in claim 1, wherein at least some of said warp yarns are monofilament yarns.

7. A papermaker's fabric as claimed in claim 1, wherein at least some of said weft yarns are monofilament yarns.

8. A papermaker's fabric as claimed in claim 1, wherein at least some of said warp yarns are polyester yarns.

9. A papermaker's fabric as claimed in claim 1, wherein at least some of said warp yarns are polyamide yarns.

10. A papermaker's fabric as claimed in claim 1, wherein at least some of said warp yarns are polyphenylene sulfide yarns.

11. A papermaker's fabric as claimed in claim 1, wherein at least some of said warp yarns are modified heat-, hydrolysis-, and contaminant-resistant polyester yarns.

12. A papermaker's fabric as claimed in claim 1, wherein said warp yarns of said second type are opaque to ultraviolet (UV) radiation.

13. A papermaker's fabric as claimed in claim 1, wherein at least some of said weft yarns are polyester yarns.

14. A papermaker's fabric as claimed in claim 1, wherein at least some of said weft yarns are polyamide yarns.

15. A papermaker's fabric as claimed in claim 1, wherein at least some of said weft yarns are polyphenylene sulfide yarns.

16. A papermaker's fabric as claimed in claim 1, wherein at least some of said weft yarns are modified heat-, hydrolysis-, and contaminant-resistant polyester yarns.

* * * * *